United States Patent [19]

Kubo et al.

[11] Patent Number: 4,496,926

[45] Date of Patent: Jan. 29, 1985

[54] MOLDED COIL STRUCTURE

[75] Inventors: Hirofumi Kubo; Toshiyuki Fujimori, both of Niigata, Japan

[73] Assignee: Hitachi, Ltd., Tokyo, Japan

[21] Appl. No.: 370,143

[22] Filed: Apr. 20, 1982

[30] Foreign Application Priority Data

Jan. 21, 1981 [JP] Japan ..... 56-6399

[51] Int. Cl.[3] ..... H01F 27/30

[52] U.S. Cl. ..... 336/205; 336/96; 336/198

[58] Field of Search ..... 336/96, 198, 199, 205

[56] References Cited

U.S. PATENT DOCUMENTS

| | | | |
|---|---|---|---|
| 1,944,870 | 1/1934 | Apple | 336/205 X |
| 2,464,568 | 3/1949 | Flynn et al. | 336/205 X |
| 3,240,848 | 3/1966 | Burke et al. | 336/96 X |

*Primary Examiner*—A. D. Pellinen
*Assistant Examiner*—Susan Steward
*Attorney, Agent, or Firm*—Antonelli, Terry & Wands

[57] ABSTRACT

An economical and light-weight molded coil structure wherein sheet-form electrical insulator layers containing a thermosetting resin are wrapped around the inner and outer peripheries of a coil to function as a casting mold, and end-enclosing resin layers are applied to the both end faces respectively of the coil not covered with the sheet-form insulator layers. A gas is charged to be sealed in the coil.

5 Claims, 9 Drawing Figures

MOLDED COIL STRUCTURE

This invention relates to a molded coil structure in a resin-molded transformer.

A resin-molded transformer employing a thermosetting resin for the electrical insulation of its coils has various merits including ease of maintenance and inspection, high reliability of insulation and incombustibility, and, therefore, there is an ever-increasing demand for such a transformer. However, conventional resin-molded transformers have various defects due to the manufacturing process in which coils are positioned within a mold, and, after casting a thermosetting resin into the mold while evacuating the interior of the mold, applying heat to set the resin under heat thereby obtaining a molded transformer structure.

For a better understanding of the present invention, the prior art manufacturing process will be described with reference to FIGS. 1, 2*a* and 2*b*, according to these figures, a completed molded coil structure, a bobbin 2, and a coil 3 wound in cylindrical form around the bobbin 2. An inner shell plate 4 of cylindrical shape, an outer shell plate 5 of also cylindrical shape, an upper end plate 6 and a lower end plate 7 constitute a resin casting mold, with packings 8 maintaining a gas-tight seal between the shell plates and the end plates. The coil 3 is disposed in a predetermined position within the mold by spacers 9 and is then subjected to pre-drying in that state. Then, while evacuating the interior of the mold by a vacuum pump, a thermosetting resin 10 is cast into the mold. Subsequently, the mold is transferred into a heating furnace to set the resin 10, under heat, and, after setting the resin and allowing the mold to cool down to the atmospheric temperature, the resin block enclosing the coil 3 therein is separated from the mold to complete the molded coil structure.

The prior art molded coil structure manufactured by the process described above has the following defects:

(a) A large-scale casting equipment including a vacuum tank, a vacuum pump and a mixing vessel are required, and, therefore, the cost of initial equipment investment is large.

(b) Many molds must be prepared to deal with a variety of types of coils, and many man-hours are also required for the assembling of the molds and separation of products from the molds.

(c) One bobbin is required for each of the coils since the resin is cast to mold the coil mounted on the bobbin. Further, due to the fact that the coil is molded in the state mounted on the bobbin, transfer of heat into the resin is obstructed during the step of setting of the resin under heat, and the resin is not always uniformly set, resulting in a source of occurrence of cracks in the resin.

(d) For the molding of each individual coil, one bobbin and one mold are occupied from the step of casting of the resin to the step of setting of the resin, resulting in poor efficiency of utilization of the bobbins and molds.

(e) Further, in the molded coil structure produced by the above-described manufacturing process in which the resin is cast into the mold while evacuating the interior of the mold, the resin ought to be sufficiently uniformly impregnated between the conductors of the coil. Actually, however, voids of vacuum are formed between the conductors of the coil because the resin cast into the mold has a viscosity although it may not be so high.

As shown in FIG. 3, when the resin 10 is cast into the mold, the conductors 11 of the coil 3 are buried in the resin 10, and layer insulators 12 are interposed between the layer of the conductors 11, with voids 13 of vacuum being formed between the conductors. Although the resin 10 is set by application of heat thereto in the state shown in FIG. 3, the internal pressure of the voids 13 is still maintained at a vacuum of about 1 Torr. The corona starting voltage is generally defined by the Paschen's law. According to this Paschen's law, the corona starting voltage is lowest at such a pressure level of the voids 13. Accordingly, corona discharge tends to occur between the conductors 11 of different phases in the molded coil structure including the vacuum voids 13 described above. In order to eliminate the tendency of occurrence of corona discharge, it is required to increase the spacing between the conductors 11 of different phases or to split the coil into a plurality of segments thereby suppressing the level of voltage acting between the conductors 11 of different phases. Such a requirement increases the number of molded-coil manufacturing steps and also increases the dimensions and weight of the molded coil structure, resulting inevitably in an increased manufacturing cost.

It is therefore an object of the present invention to provide an economical and light-weight molded coil structure which can be manufactured without requiring a large-scale manufacturing equipment.

Another object of the present invention is to provide a molded coil structure of good quality which substantially eliminates the possibility of occurrence of cracks in the resin.

Still another object of the present invention is to provide a molded coil structure of small size exhibiting an excellent corona discharge suppression effect.

The molded coil structure according to the present invention is featured by the fact that sheet-form layers of an electrical insulator impregnated with a resin are wrapped around the inner and outer peripheries respectively of a coil to provide a mold, and a resin is coated only on the end faces of the coil not covered with the sheet-form insulator layers.

Other objects, features and advantages of the present invention will become more apparent from the following detailed description of preferred embodiments thereof taken in conjunction with the accompanying drawings, in which:

FIG. 1 is a perspective view of a prior art resin-molded coil structure;

FIG. 2*a* is a partial cross sectional elevational view of a resin molded coil structure of FIG. 1;

FIG. 2*b* is a cross-sectional view taken along line 2*b*—2*b* in FIG. 2*a;*

Figure 1:
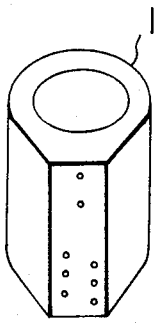
FIG. 1 PRIOR ART
Figure 2A:
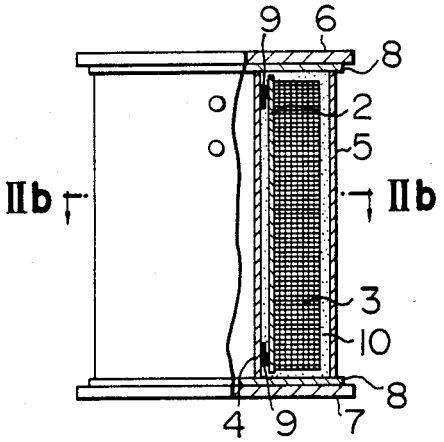
FIG. 2a PRIOR ART
Figure 3:
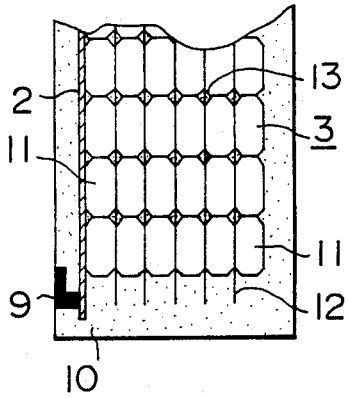
FIG. 3 PRIOR ART
FIG. 3 is an enlarged view of part of the coil in FIG. 2*a;*
Figure 2B:
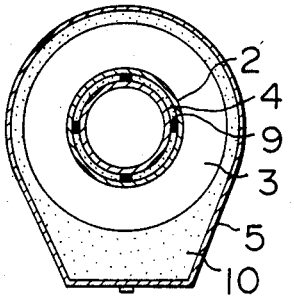
FIG. 2b PRIOR ART
Figure 4:
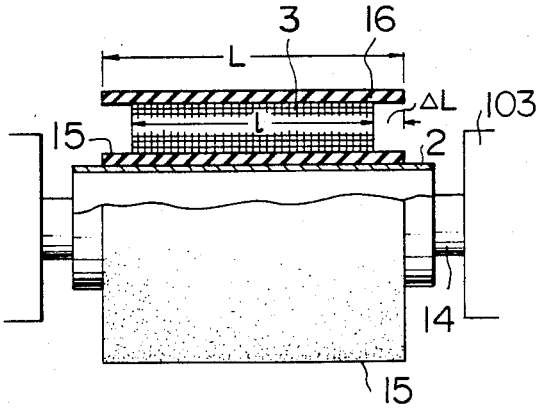
FIG. 4 is a partial cross sectional elevational view of an embodiment of the resin-molded coil structure of the present invention illustrating a state after the step of winding of a coil between sheet-form electrical insulator layers.

Referring now to the drawings wherein like reference numerals are used throughout the various views to designate like parts and, more particularly to FIG. 4, according to this figure, a molded coil structure including, for example, a single coil, comprises a coil bobbin 2 mounted on the spindle 14 of a winding machine 103, with the bobbin 2 being formed of a metal so that it may be re-used. A layer 15 of an electrical insulator material is wrapped around an outer periphery of the bobbin 2, with the insulator layer 15 being in the form of sheet or tape of a fibrous electrical insulating material such as, for example, a fibrous glass or a fibrous polyester impregnated with a semi-set epoxy resin or like resin. The insulator layer 15 is wrapped around the bobbin 2 mounted on the spindle 14 of the winding machine 103 after coating a mold-separating agent on the bobbin 2. Then, while rotating the bobbin 2 mounted on the spindle 14, the conductors and layer insulators are alternatively wound around the outer periphery of the insulator layer 15 to form a coil 3.

After the formation of the coil 3, a sheet-form or tape-form layer 16 of an electrical insulator material, which may be the same as the insulator material of the layer 15, is wrapped around the outer periphery of the coil 3. The length L of the insulator layers 15, 16 is selected to be larger than the length l of the coil 3 so that the insulator layers 15, 16 protrude a short distance $\Delta L$ beyond the both end faces of the coil 3.

Subsequently, the assembly of the coil 3 and the insulator layers 15, 16 is removed together with the bobbin 2 from the spindle 14 of the winding machine 103 and is transferred into a heating furnace to be subjected to pre-drying. By the step of pre-drying, the coil 3 is dehydrated, and, at the same time, the resin impregnated in the insulator layers 15, 16 is completely set under heat.

Figure 5:
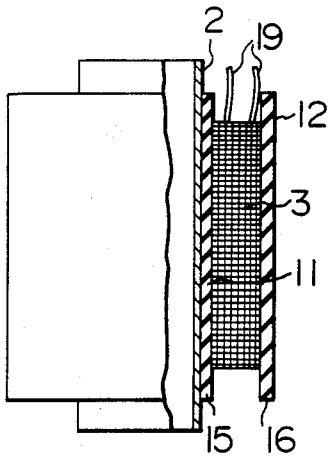
FIG. 5 is a partial cross sectional elevational view of a coil of the present invention illustrating the step of pre-drying.
Figure 6:
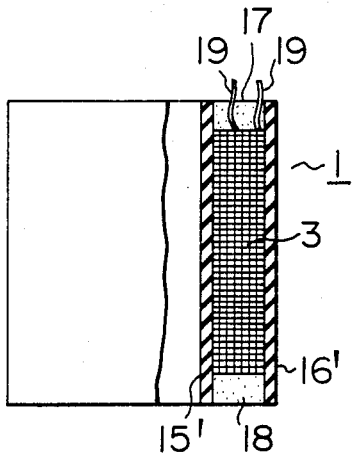
FIG. 6 is a partial cross sectional elevational view of a coil of the present invention illustrating the step of applying a putty of a resin to each of the end faces of the coil not covered with the electrical insulator layers, after withdrawal of the bobbin.

After the step of pre-drying with the coil assembly in the state shown in FIG. 5, the bobbin 2 is withdrawn. The bobbin 2 can be withdrawn without causing deformation of the coil 3 since, at this time, the insulator layers 15, 16 have a sufficient rigidity and are sufficiently bonded to the coil 3 due to the complete setting of the resin impregnated therein. Then, as shown in FIG. 6, end-enclosing putties 17, 18 of a resin such as, for example, an epoxy resin, are applied by, for example, a brush, to the respective end faces of the coil 3 which has the inner and outer peripheries thereof enclosed by the completely-set insulator layers 15' and 16'. The surfaces of the end-enclosing resin putties 17 and 18 are then finished so as to be smooth and flat.

The application of the end-enclosing resin putties 17, 18 can be accomplished in the atmospheric air. For example, this step includes applying the end-enclosing resin putty 17 to one of the end faces of the coil 3, transferring the assembly into a heating furnace to set the resin putty 17, inverting the assembly and applying the end-enclosing resin putty 18 to the other end face of the coil 3, transferring the assembly into the heating furnace again to set the resin putty 18, and allowing the assembly to gradually cool down to complete the molded coil structure. In this example, one of the end-enclosingresin putties 17 or 18 is set first, and, then, the other is set. This manner of setting under heat is effective especially when the viscosity of the end-enclosing resin putties 17 or 18 is considerably low or when the end-enclosing resin is in liquid form instead of the putty form. Even when the end-enclosingresin in liquid form is applied in the atmospheric air, it would not permeate into the coil 3. The use of an end-enclosing resin in putty form having a high viscosity is advantageous in that, after withdrawal of the bobbin 2, the end-enclosing resin putties 17, 18 applied simultaneously to the both end faces of the coil 3 can be simultaneously set under heat. In this case, the period of time required for the application of the end-enclosing resin 17, 18 can be greatly shortened since the thickness of the resin layer is small, and the period of time required for setting the resin under heat can also be greatly shortened since heat is satisfactorily uniformly transferred into the resin to uniformly set the resin. In FIGS. 5 and 6, a pair of leads 19 are shown leading out from one of the end faces of the coil 3.

In the molded coil structure 1 manufactured according to the present invention, the interior of the coil 3 is maintained substantially at the atmospheric pressure.

It will be understood that the above-described embodiment of the present invention is advantageous over the prior art molded coil structure in that the mold of prior art form as well as a large-scale casting equipment is unnecessary, and all the steps including the step of resin application can be performed in the atmospheric air. In addition, the embodiment of the present invention is advantageous in that the utilization efficiency of the bobbin 2 can be enhanced since the bobbin used for the winding of the coil 3 can be withdrawn from the coil 3 after the step of pre-drying of the assembly, so that it can be re-used. Accordingly, the number of manufacturing steps can be greatly decreased to improve the massproductivity of the molded coil structure, and the elimination of the necessity of a large-scale manufacturing equipment can reduce the manufacturing cost of the molded coil structure. Further, because of the small thickness of the resin layers of the resin putties 17, 18 enclosing the end faces of the coil 3, heat can be substantially uniformly transferred into the resin in the step of setting under heat thereby uniformly setting the resin under heat, so that a molded coil structure of good quality substantially free from cracks can be produced. Further, due to the fact that the resin does not permeate into the coil 3, the weight of the molded coil structure can be made lighter by the corresponding amount than the prior art one, and the ease of conveyance of the molded coil structure can attain a corresponding reduction of the production cost of the molded coil structure.

Figure 7:
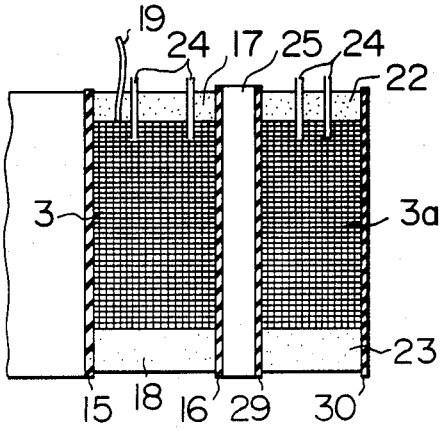
FIG. 7 is a partial cross sectional elevational view of another embodiment of the molded coil structure according to the present invention.

As shown in FIG. 7, the coil 3 of FIGS. 4 to 6 forms a primary coil, with a secondary coil **3*a* being wound around the primary coil 3. A sheet-form electrical insulator layer 29 is wrapped around the outer periphery of the electrical insulator layer 16 with a duct 25 interposed therebetween, and another sheet-form electrical insulator layer 30 is wrapped around the outer periphery of the coil 3*a*. The material of these insulator layers 29 and 30 is the same as that of the insulator layers 15 and 16. End-enclosing resin putties 22 and 23 are applied to the respective end faces of the coil 3*a*, and pipes 24 of a heat-resistive material provide a means for communication between the interior and the exterior of the coils 3 and 3*a***.

A process for manufacturing embodiment of FIG. 7 is as follows.

As described above in connection with reference to FIG. 4, the insulator layer 15 is wrapped around the bobbin 2, and, then, the primary coil 3 is wound around the outer periphery of the insulator layer 15. In this step, the heat-resistive communication pipes 24 are inserted at one end thereof into the primary coil 3 to protrude at the other end thereof to the exterior from one of the end faces of the primary coil 3, so that they act as means for communication between the interior and the exterior of the primary coil 3. Then, the secondary coil 3*a* is wound around the primary coil 3 with the insulator layer 16, duct 15 and insulator layer 29 interposed in the above order therebetween. In this step, the heat-resistive communication pipes 24 are inserted at one end thereof into the secondary coil 3*a* to protrude at the other end thereof to the exterior from one of the end faces of the secondary coil 3*a*, so that they act as means for communication between the interior and the exterior of the secondary coil 3*a*, as in the case of the primary coil 3. Subsequently, as in the case of the first embodiment, the assembly is removed from the winding machine 103 and is transferred into the heating furnace to be subjected to the step of pre-drying for dehydrating the coils 3, 3*a* and completely setting the insulators 15, 16, 29, 30. Then, the end-enclosing resin putties 17, 18 and 22, 23 are applied to the end faces of the coils 3 and 3*a*, respectively, to provide the molded coil structure shown in FIG. 7. The heat-resistive communication pipes 24 may be buried in the end-enclosing resin putties in the step of applying the putties. The molded coil structure is then transferred into the heating furnace again to set the end-enclosing resin putties 17, 18, and 22, 23 applied to the end faces of the coils 3 and 3*a*, and is then allowed to gradually cool down to the atmospheric temperature to complete the manufacture of the molded coil structure. The end-enclosing resin putties 17, 18 and 22, 23 can be applied in an atmosphere of atmospheric pressure as in the case of the first embodiment. A gas exhibiting an excellent corona discharge suppression effect, that is, a gas effective for substantially inhibiting occurrence of corona discharge is charged through the pipes 24 into the coils 3 and 3*a* of the completed molded coil structure, and, then, the openings of the pipes 24 are hermetically closed. The gas may be oxygen or sulfur hexafluoride ($SF_6$), or it may be air at atmospheric pressure. The gas pressure is preferably equal to or higher than the atmospheric pressure. One of the pipes 24 extending into each of the coils 3 and 3*a* at one of the end faces is used for charging the gas, and the other is used for discharging the gas. In the step of setting, under heat, the coil end-enclosing resin putties 17, 18 and 22, 23 in the furnace, the gas charged into the coils 3, 3*a* will be subjected to a thermal expansion. However, the expanding portion of the gas can be vented to the exterior through the pipes 24, and no pressure is imparted to the coil end-enclosing resin putties 17, 18 and 22, 23 being set under heat, so that the adverse effect such as development of cracks in the resin can be avoided.

Figure 8:
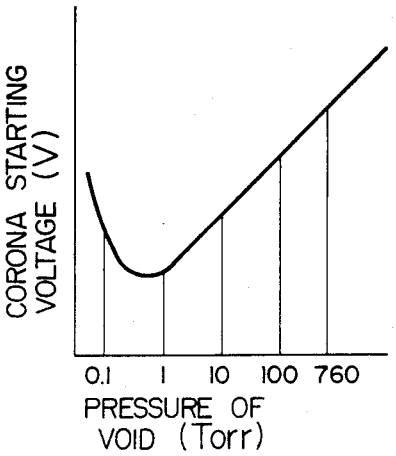
FIG. 8 is a graph showing a relationship between the pressure of voids in the coil and the corona starting voltage.

FIG. 8 is a graph illustrating how the corona starting voltage tends to vary relative to the ambient pressure according to the Paschen's law. It will be readily seen from FIG. 8 that the corona starting voltage is low when the pressure of voids is about 0.1 Torr to 1.0 Torr, while it becomes progressively higher as the pressure increases progressively up to the atmospheric pressure of 760 Torr. At the pressure of 760 Torr, the corona discharge is difficult to occur, and the corona discharge suppression effect is improved up to the level where it is three to four times as high as that in the former pressure range. FIG. 8 is based on the results of measurement under the condition of maintaining the spacing between the corona discharge electrodes constant, and the vertical and horizontal axes represent the corona starting voltage and the pressure of voids developing the corona discharge, respectively.

According to the second embodiment of the present invention, therefore, the corona discharge suppression effect can be greatly improved by maintaining the internal pressure of the individual coils 3, 3*a* at about the atmospheric pressure, and the voltage acting between the layers of the conductors of the coils 3, 3*a* can be set at a high level. This means that the dimensions of the individual coils 3, 3*a* can be made smaller than those of the prior art, provided that the capacities of the individual coils 3, 3*a* are the same as those of the prior art. Although a gas is externally supplied into the individual coils 3, 3*a*, the end-enclosing resin may include a substance which emits the desired gas (the gas exhibiting the satisfactory corona discharge suppression effect) when the resin is heated in the step of heating or when the molded coil structure is heated in use. Further, although the coil 3, 3*a* or coils of cylindrical shape are illustrated by way of example, it is apparent that the present invention is equally effectively applicable to coils of a disc shape.

What is claimed is:

1. A molded coil structure comprising a coil formed by winding a conductor, a sheet of electrical insulator material respectively wrapped in layers around an inner and an outer periphery of said coil, said layers of insulating material being impregnated with a resin, end-enclosing resin layers covering only end faces of said coil not covered with said layers of insulating material, and a gas charged in an internal space of said coil and sealed therein such that a pressure of the gas is maintained substantially at an atmospheric pressure and the gas uniformly fills the internal space of the coil.

2. A molded coil structure as claimed in claim 1, wherein said insulating material is a fibrous material having the resin impregnated therein, said layers of insulating material are respectively wrapped around the inner and outer peripheries of said coil so as to extend a short distance beyond the end faces of said coil, and said end-enclosing resin layers are disposed in spaces defined between said layers of insulating material and th respective end faces of said coil.

3. A molded coil structure as claimed in claim 1 or 2, wherein said end-enclosing resin layers are provided by setting a resin in putty form by heat.

4. A molded coil structure as claimed in one of claims 1 or 2, wherein said end-enclosing resin layers include gas passage means for communicating the internal space of said coil with the atmosphere so as to maintain the pressure of said gas at atmospheric pressure.

5. A molded coil structure as claimed in claim 4, wherein said gas passage means is a pipe of a heat-resistive material.

* * * * *